US008365407B2

(12) United States Patent
Wei

(10) Patent No.: US 8,365,407 B2
(45) Date of Patent: Feb. 5, 2013

(54) RADIATOR MANUFACTURING METHOD AND ALIGNING-AND-MOVING MECHANISM THEREOF

(75) Inventor: Wen-Chen Wei, Taipei (TW)

(73) Assignee: Neng Tyi Precision Industries Co., Ltd., Taipei (TW)

( * ) Notice: Subject to any disclaimer, the term of this patent is extended or adjusted under 35 U.S.C. 154(b) by 967 days.

(21) Appl. No.: 12/423,028

(22) Filed: Apr. 14, 2009

(65) Prior Publication Data

US 2010/0257734 A1 Oct. 14, 2010

(51) Int. Cl.
*B21D 53/02* (2006.01)

(52) U.S. Cl. ..... 29/890.03; 29/726; 29/33 G

(58) Field of Classification Search ..... 29/33 G, 29/726, 726.5, 727, 890.03, 890.039, 890.046, 29/412–418, 429–431, 462, 464, 466–468, 29/525, 525.06; 165/182–185
See application file for complete search history.

(56) References Cited

U.S. PATENT DOCUMENTS 1,930,161 A * 10/1933 Dewald ..... 29/33 G
2,176,657 A * 10/1939 Finch ..... 313/21
2,289,984 A * 7/1942 Mouromtseff et al. ..... 165/79
3,148,441 A * 9/1964 Schuler ..... 29/890.048
3,373,803 A * 3/1968 Steinberg et al. ..... 165/182
3,727,294 A * 4/1973 Coller ..... 29/429
3,789,479 A * 2/1974 Zifferer et al. ..... 29/726
4,236,299 A * 12/1980 Joekel et al. ..... 29/727
4,330,913 A * 5/1982 Kritzer ..... 72/325
4,380,106 A * 4/1983 Jonason ..... 29/890.047
4,380,868 A * 4/1983 Hall ..... 29/726
4,486,933 A * 12/1984 Iwase et al. ..... 29/726
4,543,711 A * 10/1985 Wada et al. ..... 29/726
4,547,952 A * 10/1985 Greever et al. ..... 29/451
4,637,132 A * 1/1987 Iwase et al. ..... 29/726
4,698,904 A * 10/1987 Nozawa et al. ..... 29/726
5,226,234 A * 7/1993 Beddome et al. ..... 29/890.039
5,426,847 A * 6/1995 Honma et al. ..... 29/726
5,996,217 A * 12/1999 Tokunaga et al. ..... 29/726
6,332,266 B1 * 12/2001 Park et al. ..... 29/726
6,530,144 B1 * 3/2003 Hong ..... 29/726.5
6,538,888 B1 * 3/2003 Wei et al. ..... 361/697
6,633,484 B1 * 10/2003 Lee et al. ..... 361/697
6,758,262 B2 * 7/2004 Kawabata et al. ..... 165/80.3
2005/0211416 A1 * 9/2005 Kawabata et al. ..... 165/80.3

* cited by examiner

*Primary Examiner* — David Bryant
*Assistant Examiner* — Ryan J Walters
(74) *Attorney, Agent, or Firm* — Rosenberg, Klein & Lee

(57) ABSTRACT

A method for manufacturing a radiator including preparing, aligning, punching, bending, shearing and riveting, rotating, and removing processes is provided. The shearing, riveting, and rotating processes are repeated. A sheet metal is continuously punched to form a plurality of heat dissipation fins in a manufacturing machine, the heat dissipation fins are then orderly sheared, inserted into the metal base, and further fixed with the metal base by two-direction riveting. The radiator can thus be obtained in an automatic and faster process without unnecessary assembling steps with higher yield and reduced costs.

10 Claims, 9 Drawing Sheets

RADIATOR MANUFACTURING METHOD AND ALIGNING-AND-MOVING MECHANISM THEREOF

FIELD OF THE INVENTION

The present invention relates to a method of manufacturing a radiator, in particular, to a method of manufacturing a radiator that assembles heat dissipation fins on a metal base.

DESCRIPTION OF RELATED ART

In recent years, Light Emitting Diode (LED) has gradually replaced the traditional light source. Temperatures of the LED module of the LED lamp must be controlled lower than 80 degree Celsius in order to transform the electricity into luminous energy, not thermal energy. That is why the LED lamps have the features of low energy consumption and low heat production. Therefore, the LED lamps are usually equipped with several heat dissipation fins so as to help the LED module quickly dissipating heat.

However, most radiators in the market are mainly categorized into stacked fins and extruded aluminum fins etc. The stacked fins have a plurality of fins connected in series, but the stacked fins can form a ring-shaped body by connecting the first and the last fins, and then be further welded onto a metal base plate to form a radiator; but, after the welding process, the welded joints between the fins and the metal base plate will increase the thermal resistance of the radiator so that it is hard to meet the requirements of the high thermal conductivity. It also requires two phase refining processes, which wastes time and labors, and increases manufacturing cost.

In addition, the extruded aluminum fins are made first by manufacturing a set of extruded aluminum mold; after extruded out, the aluminum is then cut according to the needed fin size; then, the burrs of the fins are removed by a polish process; finally, the appearances of the fins are beautified by a anodizing treatment. The entire procedures are complicated so that the yield is hard to increase, and the overall costs are high.

Accordingly, the present invention is provided, because of the above specified disadvantages of the prior art and based on hands on experience plus academic research and developments, to effectively improve the advantages described above.

SUMMARY OF THE INVENTION

A main object of the present invention is to provide a method for manufacturing a radiator. The method increases the manufacturing speed, reduces unnecessary assembly processes, largely improves the yield, and decreases the costs, etc.

To achieve the above-mentioned objectives, the present invention provides a method for manufacturing a radiator having a metal base and a plurality of heat dissipation fins. The method comprises a rotating and removing mechanism and preparation, alignment, punching, bending, and shearing and riveting steps. The shearing and riveting and the rotating steps are repeated for a predetermined times.

The preparation step is that placing a metal base on a manufacturing fixture of an aligning-and-moving mechanism of a manufacturing machine having a sheet metal. The metal base has a plurality of slots formed on the periphery of the metal base, and the number of the slots is defined as Y.

The alignment step is that moving the manufacturing fixture and the metal base to a position under the sheet metal by the aligning-and-moving mechanism.

The punching step is first to punch two side-portions of the sheet metal to form a plurality of positioning holes, which the positioning holes are spaced apart by equal distance. A locating pin is then inserted into the located hole. Thereafter, continuously punch the sheet metal to form a plurality of heat dissipation fins on the sheet metal, which the number of the heat dissipation fins is defined as X.

The bending step is to bend the heat dissipation fins downwards.

The shearing and riveting step is that first moving the sheet metal by the manufacturing machine to align one of the heat dissipation fins with one of the slots; then, shearing the heat dissipation fin by a shearing die of the manufacturing machine; the heat dissipation fin is inserted into the slot by the shearing die.

Further, pressing a top surface and a bottom surface of the metal base at two sides of the slot by a riveting blade of the manufacturing machine so as to generate a plastic deformation on the metal base. The deformation causes two side-walls of the slot tightly contacted the two opposite surfaces of the heat dissipation fin.

Furthermore, the rotating step is to rotate the manufacturing fixture so as to rotate the metal base 1/Y round. The shearing and riveting step is repeated for X−1 times, and the rotating step is repeated for Y−1 times. The rest of the heat dissipation fins of the sheet metal are orderly assembled with the Y−1 slots.

After repeating the shearing and riveting step and rotating step, the removing step will be performed. The removing step is to remove the metal base and the heat dissipation fins, after assembly, from the manufacturing fixture. A radiator is achieved.

The efficacy of the present invention is as follows. Via the sheet metal being continuously punched to form the heat dissipation fins in the manufacturing machine, and the heat dissipation fins being orderly inserted into and riveted with the metal base, a radiator can be assembled in an automatic process. The automatic process eliminates the need of a welding process to weld the heat dissipation fins on the metal base, so that thermal resistance problems can be avoided.

The radiator can be manufactured faster, and the unnecessary assembling steps of the radiator can be reduced. Comparing the traditional method for manufacturing the extruded aluminum fins, the method of present invention is simpler and faster, so the yield of the radiator can be improved largely, and the costs of the radiator can be decreased.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are merely provided for reference and illustration, without any intention to be used for limiting the present invention.

DETAILED DESCRIPTION OF PREFERRED EMBODIMENTS

Figure 1:
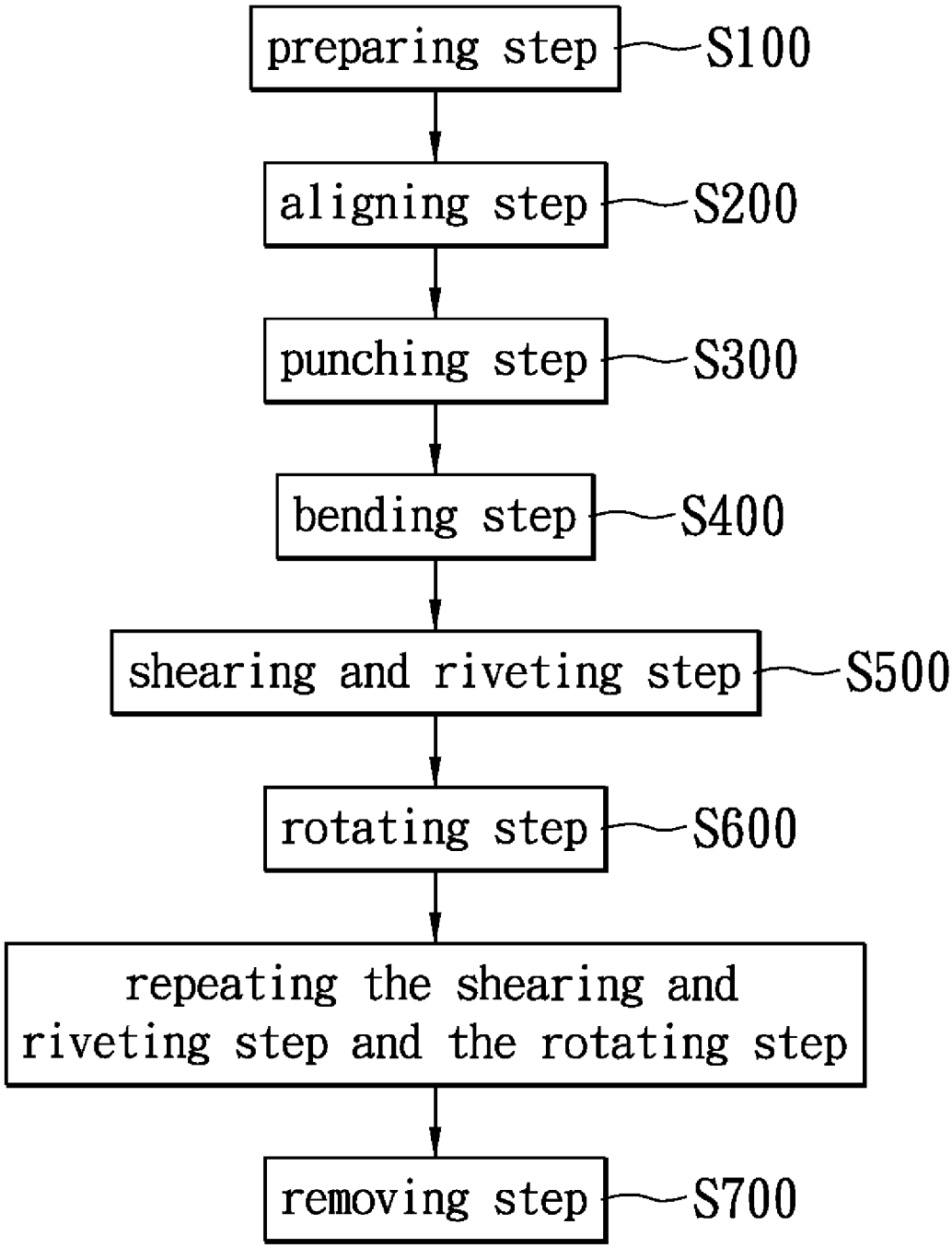
FIG. 1 is a flowchart diagram according to a preferred embodiment of the present invention.
Figure 2:
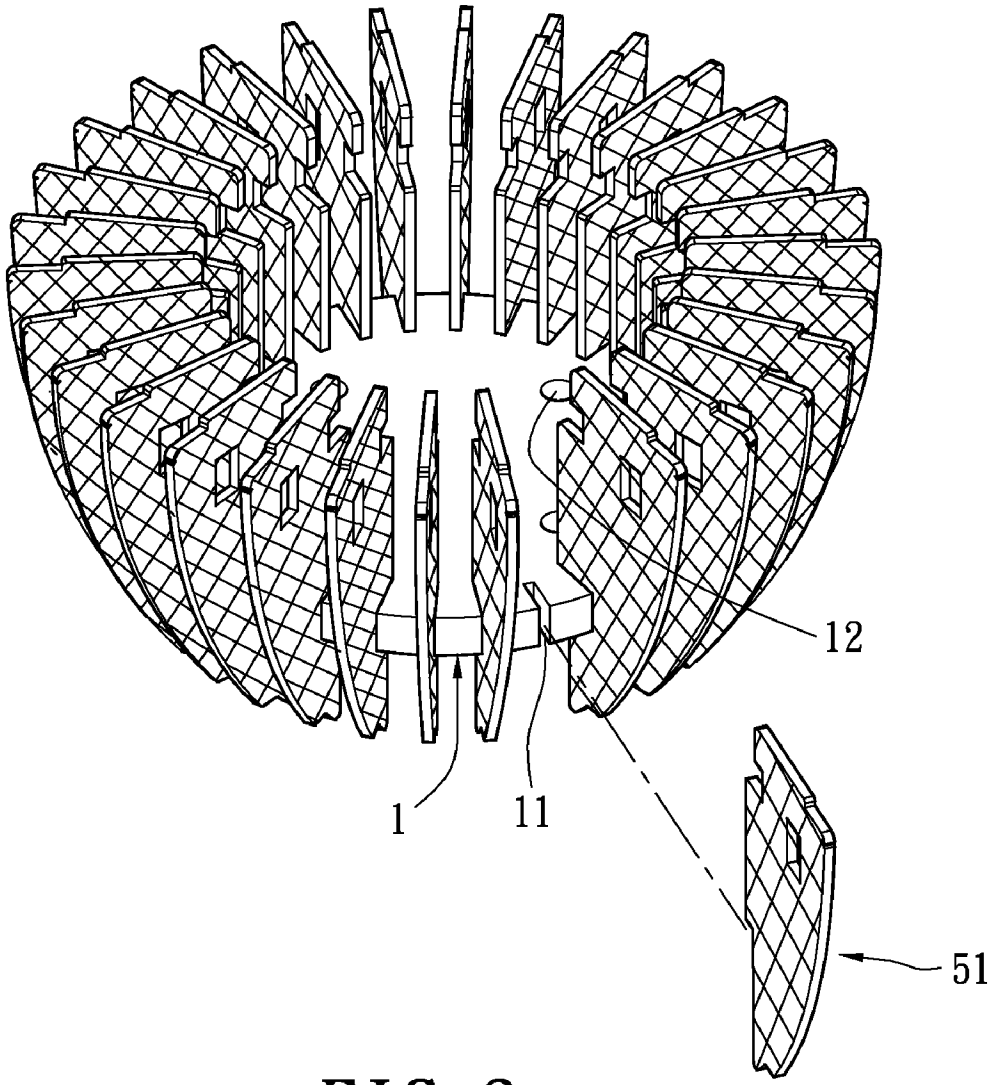
FIG. 2 is a perspective view showing a radiator according to a preferred embodiment of the present invention.

Referring now to FIGS. 1 and 2, an embodiment of the present invention discloses a method for manufacturing a radiator. The method includes automatically manufacturing a radiator having a metal base 1 and a plurality of heat dissipation fins 51.

Specifically, the method comprises a preparing step (S100), an aligning step (S200), a punching step (S300), a bending step (S400), a shearing and riveting step (S500), a rotating step (S600), repeating the shearing and riveting step (S500), the rotating step (S600), and a removing step (S700). A number of the heat dissipation fins 51 are defined as X, which the X is a natural number. The metal base 1 is a round plate, and manufactured by a stamping process. The metal base has a plurality of slots 11 and a plurality of positioning holes 12. The slots 11 are formed on the periphery of the metal base 1. A number of the slots 11 is defined as Y, which is corresponding to the number X of the heat dissipation fins 51.

Figure 3:
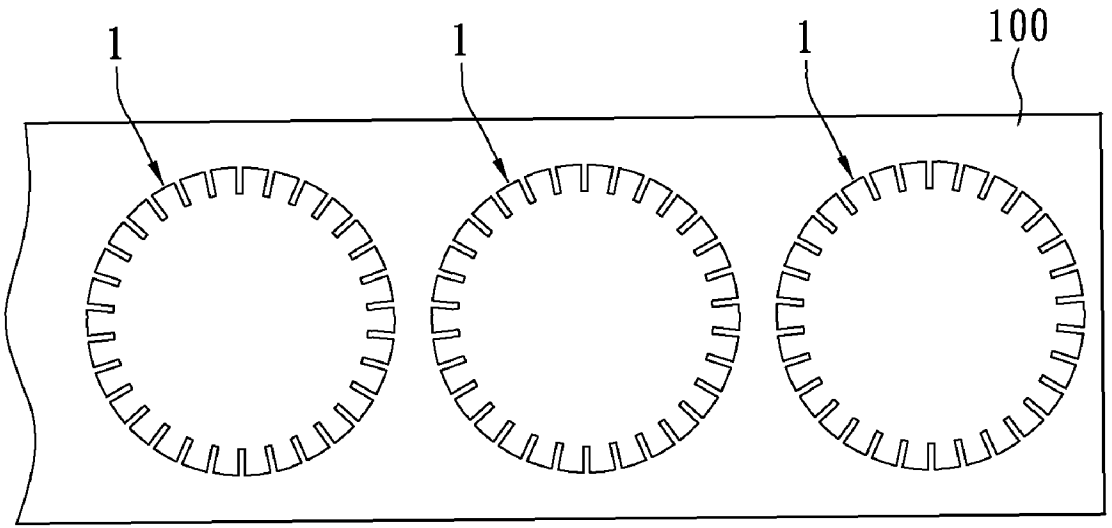
FIG. 3 is a schematic view showing a plurality of metal bases at a metal plate according to a preferred embodiment of the present invention.
Figure 4:
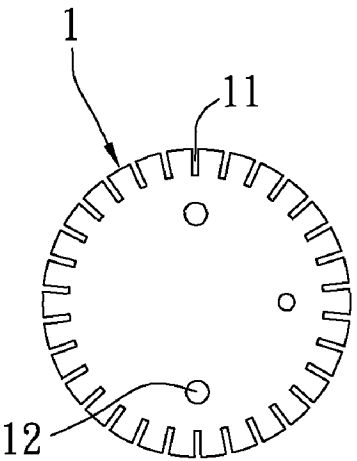
FIG. 4 is a top view of a metal base after being stamped according to a preferred embodiment of the present invention.

To describe further, please referring to FIGS. 3 and 4, a metal plate 100 is punched by a stamping process so as to continuously or at the same time one stamping form a plurality of metal bases 1. After the metal plate 100 being punched, the Y slots 11 are also one stamping formed at the periphery of the metal base 1. Using the stamping process forming the metal base 1 possesses, on the one hand, the advantage of fast manufacturing and, on the other hand, the metal base 1 with the positioning holes 12 by stamping.

Please referring to FIG. 1 and FIG. 5, the preparing step (S100) is as follows. The metal base 1 is manually placed on a manufacturing fixture 40 of an aligning-and-moving mechanism 30 of a manufacturing machine 3, which the manufacturing machine 3 has a sheet metal 50. The manufacturing fixture 40 has a plurality of positioning columns 41. The positioning column 41 are inserted into the positioning hole 12 of the metal base 1, so that the metal base 1 is located and fixed at the manufacturing fixture 40.

The aligning-and-moving mechanism 30 comprises a frame 31, a pulling arm 32, and a slide rail assembly 33. The frame 31 is mounted at one end of the manufacturing machine 3. The pulling arm 32 is movably assembled with the frame 31. The slide rail assembly 33 is mounted at the frame 31 and the manufacturing machine 3. A slide chute 42 is provided at the bottom of the manufacturing fixture 40 for engaging with the slide rail assembly 33. The pulling arm 32 is used for pushing the manufacturing fixture 40 sliding on the slide rail assembly 33 to a position under the sheet metal 50.

The aligning step (S200) is as follows. The manufacturing fixture 40 and the metal base 1 are moved to the position under the sheet metal 50 by the aligning-and-moving mechanism 30. To be more specific, the fixture 40 and the metal 1 base are pushed by the pulling arm 32, and then slid on the slide rail assembly 33 to the position under the sheet metal 50.

The punching step (S300) is as follows. Two opposite side-portions of the sheet metal 50 are first punched to form a plurality of positioning holes 52 by a punching mechanism (not shown). The positioning holes 52 are spaced apart by equal distance, as shown at "A" portion of FIG. 5. A locating pin (not shown) is inserted into the positioning hole 52, so that the sheet metal 50 can be accurately located and not to be moved. The sheet metal 50 is continuously punched to form the heat dissipation fins 51 by the punching mechanism, as shown at "D" portion of FIG. 5.

Figure 5:
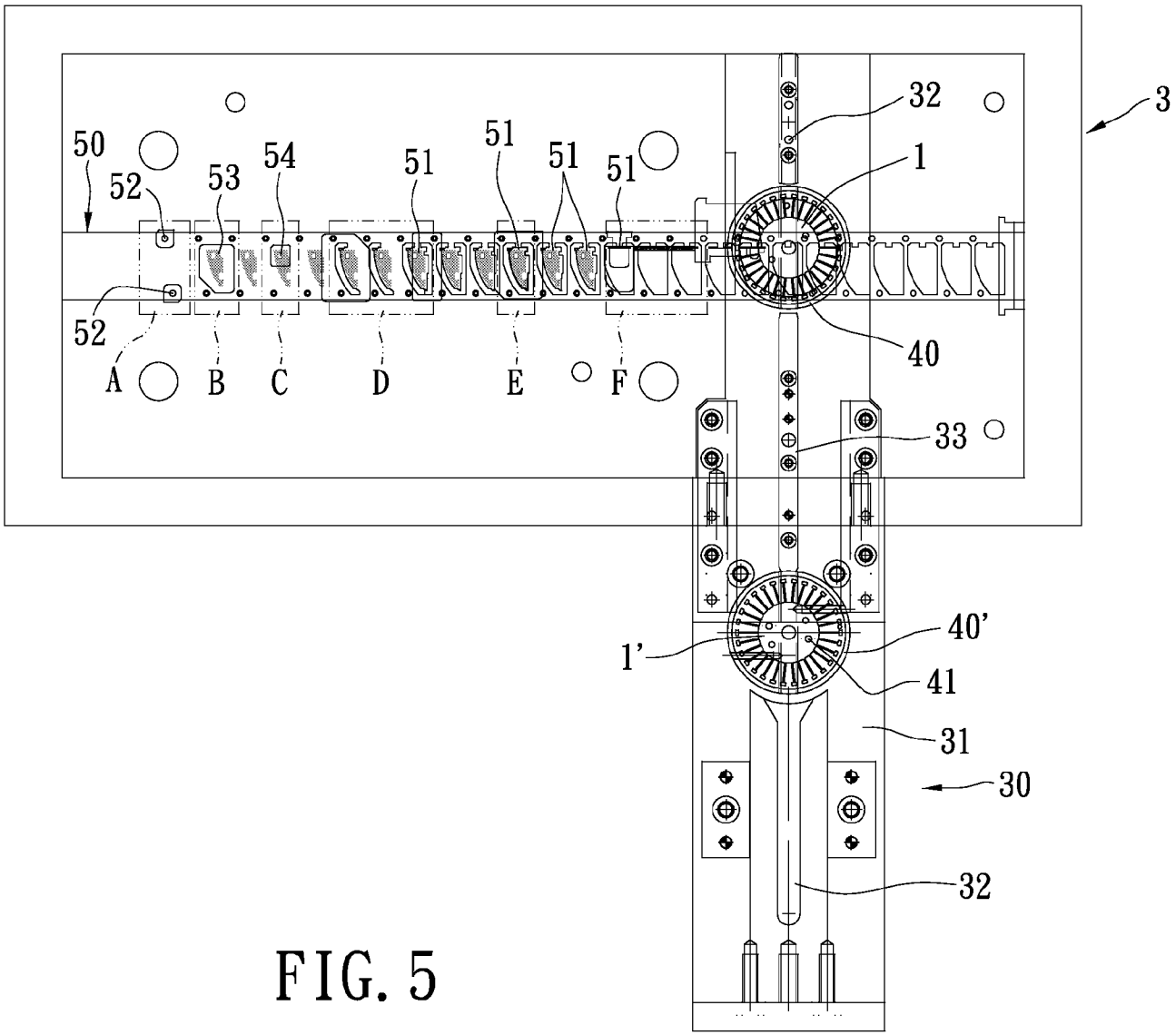
FIG. 5 is a top view of a manufacturing machine according to a preferred embodiment of the present invention.

Among the punching step (S300), after the positioning holes 52 formed, the sheet metal 50 are respectively embossed to form two embossments 53, one of the two embossments 53 is on the top surface of the sheet metal 50, the other one is on the bottom surface of the sheet metal 50, as shown at "B" portion of FIG. 5. The embossments 53 increase the heat dissipation area of the heat dissipation fin 51. Then, the sheet metal 50 is punched to form a punched slot 54, as shown at "C" portion of FIG. 5. But the punched slot 54 is optional for the heat dissipation fin 51.

Further, the sheet metal 50 is punched to stamp the predetermined shape at one-end of the heat dissipation fin 51, and then stamp the predetermined shape at another end of the heat dissipation fin 51, as shown at "D" portion of FIG. 5. In this embodiment, the left end portion of the heat dissipation fin 51 is stamped first; then, stamp the right end portion. However, it is possible to stamp the right end portion of the heat dissipation fin 51 first; then, the left end portion. Finally, the sharp burrs of the heat dissipation fin 51, which are produced via that stamping the predetermined shapes of the heat dissipation fin 51, are removed from the heat dissipation fin 51, as shown in "E" portion of FIG. 5.

The bending step (S400) (as shown in "F" portion) is to bend the abovementioned heat dissipation fin 51 downwards, and one end of the heat dissipation fin 51 is still connected to the sheet metal 50.

Figure 6:
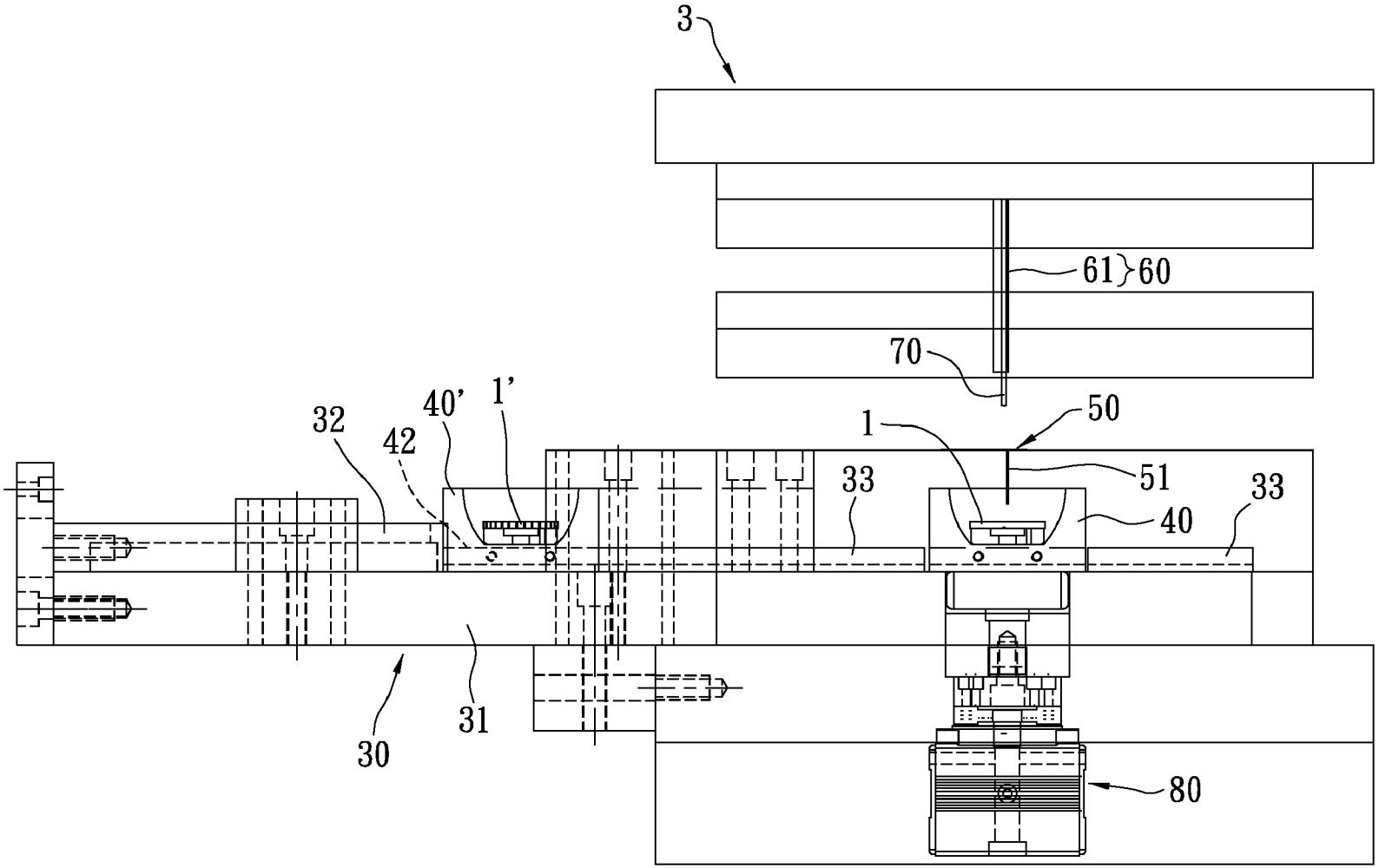
FIG. 6 is a side view of the manufacturing machine according to a preferred embodiment of the present invention.
Figure 7:
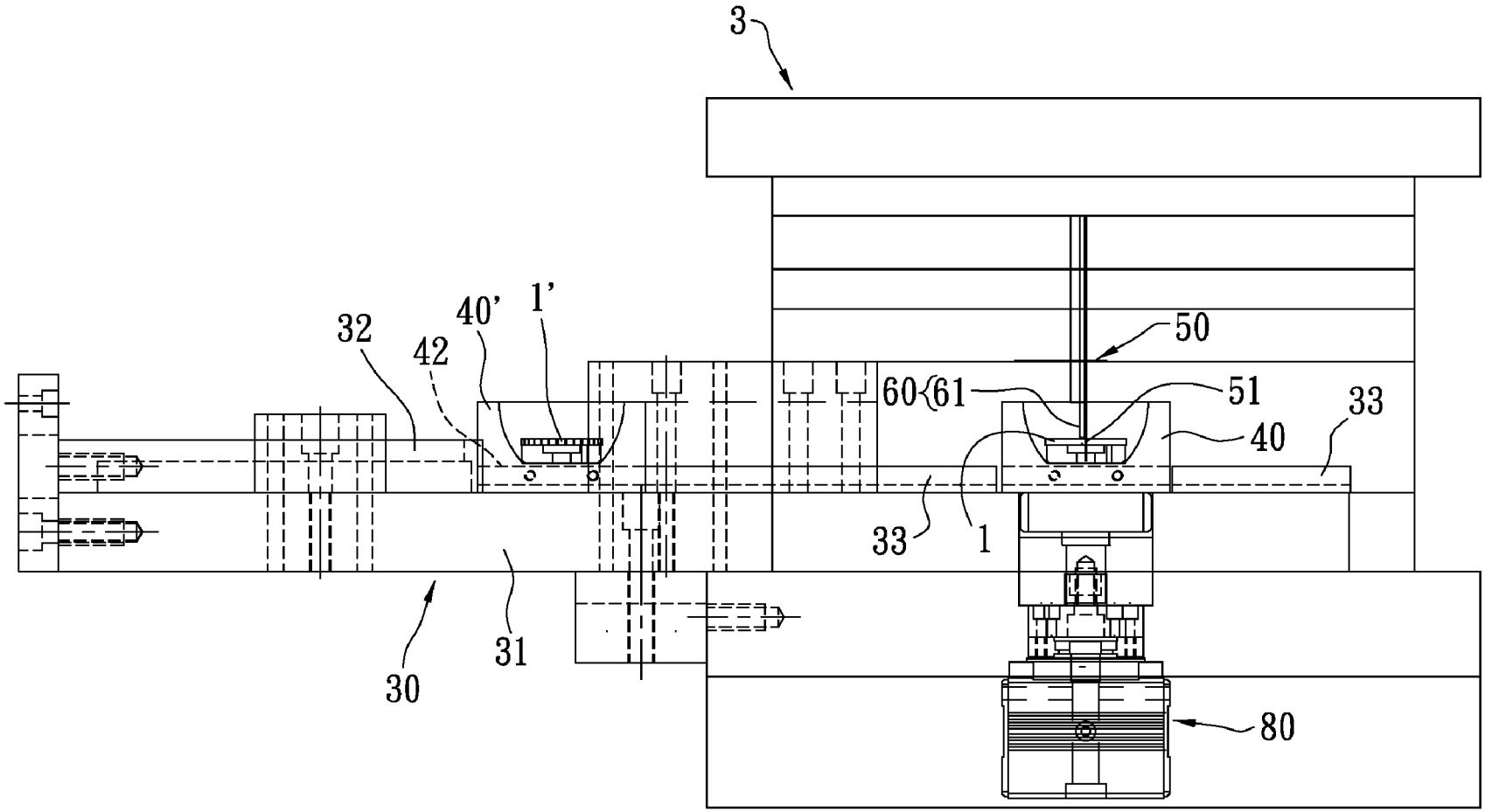
FIG. 7 is another side view of the manufacturing machine according to a preferred embodiment of the present invention, which shows a shearing die is moved down.
Figure 8:
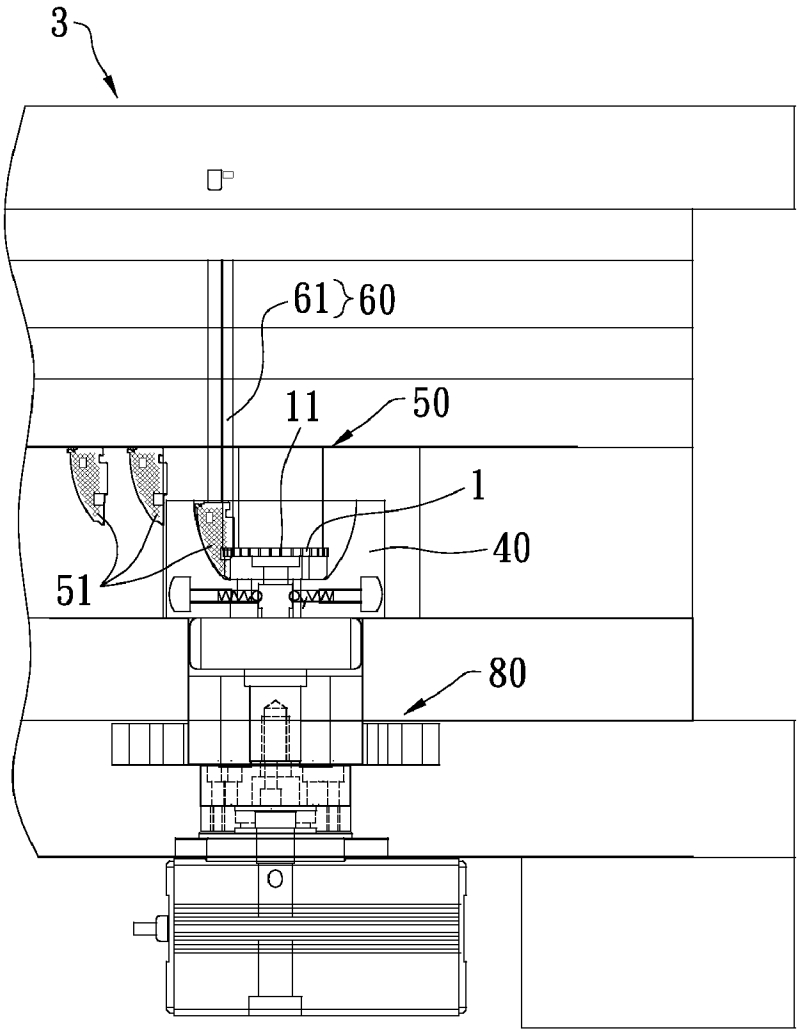
FIG. 8 is a front view of the manufacturing machine according to a preferred embodiment of the present invention, which shows a heat dissipation fin is inserted into the metal base.

Please referring to FIG. 6 to FIG. 8, the shearing and riveting step (S500) is as follows. The heat dissipation fins 51 on the sheet metal 50 are moved by the manufacturing machine 3. Hence, one of the heat dissipation fins 51 can be aligned with one of the slots 11. The heat dissipation fin 51 is then sheared and inserted into the slot 11 by a shearing die 60 of the manufacturing machine 3. For further explaining, the shearing die 60 has a vertically movable shearing punch 61 for the uses of shearing the heat dissipation fins 51 of the sheet metal 50, and inserting the heat dissipation fins 51 into the corresponding slots 11 of the metal base 1. The manufacturing fixture 40 is connected with a servo rotating mechanism 80 located under the manufacturing fixture 40. The manufacturing machine 3 has two riveting blades 70.

Figure 9:
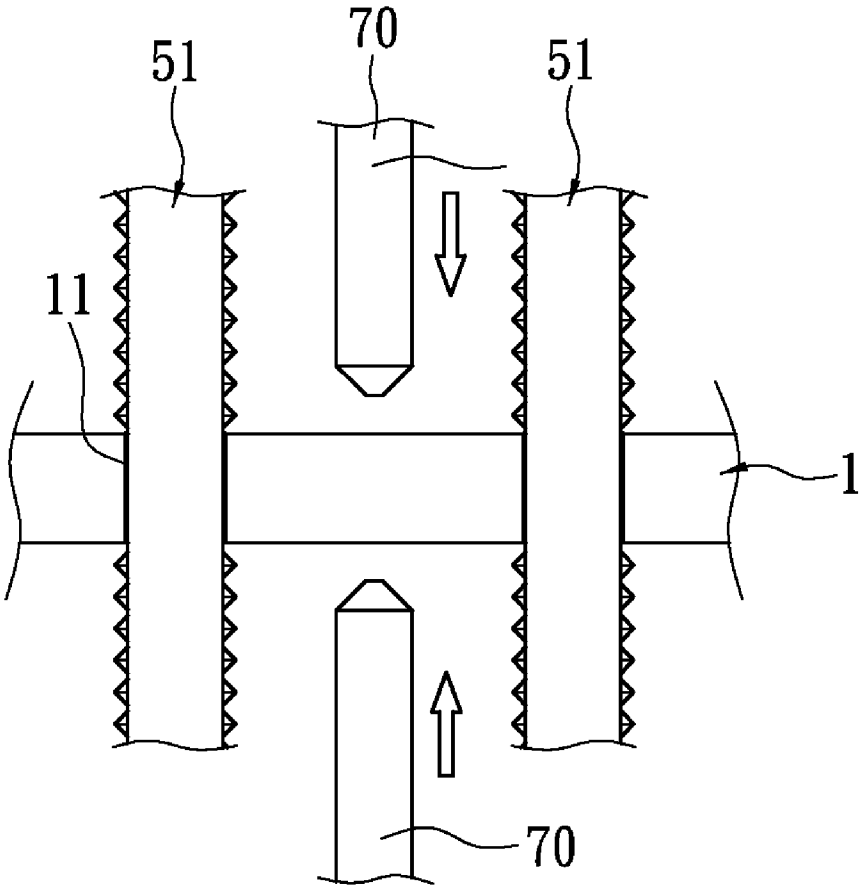
FIG. 9 is a schematic view showing two riveting blades are aimed to press the metal base according to a preferred embodiment of the present invention.

Please referring to FIG. 9, the top surface and the bottom surface of the metal base 1 at two sides of the slot 11 are pressed from two directions by the two riveting blades 70 of the manufacturing machine 3 so that a plastic deformation happened to the metal base 1. The plastic deformation causes the two side-walls of the slot 11 tightly contacted the two vertical opposite surfaces of the heat dissipation fin 51 so that the heat dissipation fin 51 can be fixed with the metal base 1.

The rotating step (S600) is performed after the abovementioned steps. The manufacturing fixture 40 is rotated, according to the number Y of the slots 11, 1/Y rounds, then, give order to the next slot 11 to align with the next heat dissipation fin 51 ready to be inserted into the slot 11.

Accordingly, after repeating the above described shearing and riveting step (S500) (X−1) times and the rotating step (S600) (Y−1) times, the heat dissipation fins 51 on the sheet metal 50 can be orderly assembled in the (Y−1) slots 11.

After completing the above described repetitive steps, the removing step (S700) can now be performed. The removing step is to remove the assembled metal base 1 and heat dissipation fins 51 from the manufacturing fixture 40 so as to obtain a radiator.

Figure 10:
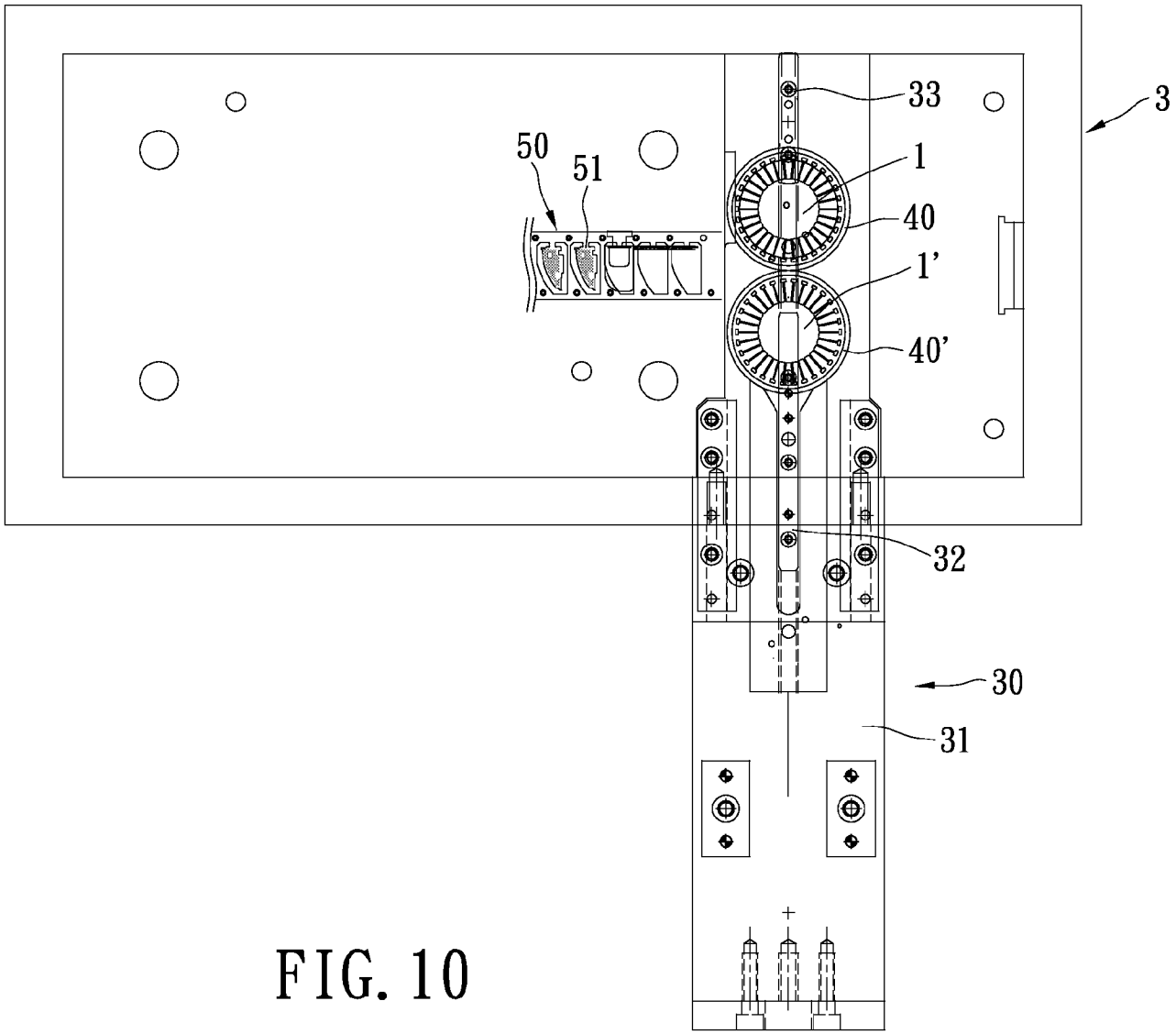
FIG. 10 is another top view of the manufacturing machine according to a preferred embodiment of the present invention, which shows an assembled radiator is pushed off by the next pending manufacturing fixture.

Please refer to FIG. 5 and FIG. 10. After the aligning step (S200) is done, the next manufacturing fixture 40' and a metal base 1' can now be placed on the aligning-and-moving mechanism 30, during any of the subsequent steps, to form a preparation step. When a radiator is assembled, the aligning step (S200) can be repeated again. The assembled radiator and the manufacturing fixture 40 are pushed off the sheet metal 50 by the ready manufacturing fixture 40'. Thereafter, the removal step (700) and the following steps of the aligning step (S200) can be completed. That is, large quantity of radiators can be manufactured quickly.

Specifically, the metal base 1 is a round plate and the round shape is good for inserting the heat dissipation fins 51 into the slots 11 of the metal base 1 in an orderly and accurate fashion, and also good for the rotating step (S600) to accurately rotate 1/Y times.

Further, the natural number X is preferably greater than ten. If X if smaller than ten, the heat dissipation provided by the heat dissipation fins 51 is less effective. In the present preferred embodiment, there are thirty heat dissipation fins 51 of the radiator. Therefore, the X is equal to 30, and the metal base 1 has thirty slots 11. Accordingly, the heat dissipation fin 51 will be riveted in the slot 11 for thirty times by the manufacturing tool 3.

In the present preferred embodiment, the manufacturing fixture 40 is connected with the servo rotating mechanism 80 located under the manufacturing fixture 40, which causes the metal base 1 to steppingly rotate 1/Y times at each of the Y slot 11.

To sum up the present invention, the present invention has made the sheet metal 50 continuously punched to form the heat dissipation fins 51 in the manufacturing machine 3, and the heat dissipation fins 51 orderly inserted into and riveted with the metal base 1, so that the radiator can be manufactured in an automatic process. Accordingly, there is no need to weld the heat dissipation fins 51 on the metal base 1, which avoids the thermal resistance problems induced by welding processes. Further the radiator can be manufactured faster, and the unnecessary assembling steps of the radiator are reduced. Comparing the traditional method for manufacturing the extruded aluminum fins, the method of present invention is simpler and faster. So the yield of the radiator can be improves largely, and the costs of the radiator are decreased.

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A method for manufacturing a radiator having a metal base and a plurality of heat dissipation fins, comprising:

preparing a metal base and placing it on a manufacturing fixture of an aligning-and-moving mechanism of a manufacturing machine, wherein the metal base has a plurality of slots at the periphery of the metal base, a number of the slots is defined as Y, the manufacturing machine has a sheet metal;

aligning and moving the manufacturing fixture and the metal base to a position under the sheet metal;

punching two side-portions of the sheet metal to form a plurality of positioning holes, wherein the positioning holes of the sheet metal are spaced apart by equal distance, the sheet metal is positioned by inserting a locating pin into one of the positioning holes thereof, the sheet metal is continuously punched to form a plurality of heat dissipation fins, a number of the heat dissipation fins is defined as X;

bending the heat dissipation fins downwards;

shearing and riveting the sheet metal moved by the manufacturing machine, wherein when one of the heat dissipation fins is aligned with one of the slots, the heat dissipation fin is sheared and inserted into the slot by a shearing die of the manufacturing machine, a top surface and a bottom surface of the metal base at two sides of the slot are pressed by a riveting blade of the manufacturing machine so that a plastic deformation is formed on the metal base and two side-walls of the slot are tightened with two opposite surfaces of the heat dissipation fin;

rotating the manufacturing fixture, wherein the metal base is rotated 1/Y circle;

repeating the shearing and riveting for X−1 times, and repeating the rotating for Y−1 times, so that the rest of the heat dissipation fins of the sheet metal are orderly assembled with the Y−1 slots; and removing the metal base and the heat dissipation fins after assembled from the manufacturing fixture to obtain a radiator.

2. The method as claimed in claim 1, wherein the number of the heat dissipation fins is greater than ten.

3. The method as claimed in claim 1, wherein, after the positioning holes are formed at the sheet metal, the sheet metal are embossed to form an embossment on the top surface or the bottom surface.

4. The method as claimed in claim 1, wherein, after the heat-dissipation-fins are formed at the sheet metal, burrs of the heat dissipation fins are sheared and removed from the heat dissipation fins.

5. The method as claimed in claim 1, wherein the manufacturing fixture is connected with a servo rotating mechanism located under the manufacturing fixture, and the metal base steppingly rotates 1/Y circle.

6. The method as claimed in claim 1 further comprises preparing a ready manufacturing fixture and a ready metal base after aligning; when the radiator is assembled and the aligning is repeated once, the radiator and the manufacturing fixture are pushed to leave the position under the sheet metal by the ready manufacturing fixture.

7. The method as claimed in claim 1, wherein the manufacturing fixture has a positioning column and the metal base has a positioning hole; the positioning column is inserted into the positioning hole of the metal base located at the manufacturing fixture.

8. The method as claimed in claim 1, wherein the metal base is a round plate.

9. The method as claimed in claim 1, wherein the aligning-and-moving mechanism comprises:

a frame, mounted at an end-portion of the manufacturing machine;

a pulling arm, movably assembled with the frame; and a slide rail assembly, mounted at the frame and at the manufacturing machine;

wherein the manufacturing fixture has a slide chute corresponding to the slide rail assembly recessed on a bottom of the manufacturing fixture, and is pushed by the pulling arm and slid on the slide rail assembly.

10. The method as claimed in claim 1, wherein the shearing die has a vertically movable shearing punch for shearing the heat dissipation fins of the sheet metal and for inserting the heat dissipation fins into the corresponding slots of the metal base.

* * * * *